US007143620B2

(12) United States Patent
Itaya

(10) Patent No.: US 7,143,620 B2
(45) Date of Patent: Dec. 5, 2006

(54) SPRING MANUFACTURING APPARATUS AND DRIVING FORCE TRANSMITTING COMPONENT MOUNTED ON THE APPARATUS

(75) Inventor: Ichiro Itaya, Tokyo (JP)

(73) Assignee: Kabushiki Kaisha Itaya Seisaku Sho, Tokyo (JP)

( * ) Notice: Subject to any disclaimer, the term of this patent is extended or adjusted under 35 U.S.C. 154(b) by 295 days.

(21) Appl. No.: 10/640,223

(22) Filed: Aug. 13, 2003

(65) Prior Publication Data

US 2004/0065130 A1 Apr. 8, 2004

(30) Foreign Application Priority Data

Oct. 3, 2002 (JP) ..... 2002-291415

(51) Int. Cl.
*B21F 35/02* (2006.01)

(52) U.S. Cl. ..... 72/137; 72/138; 72/145; 72/140

(58) Field of Classification Search ..... 72/135, 72/137, 138, 145, 140
See application file for complete search history.

(56) References Cited

U.S. PATENT DOCUMENTS 3,983,732 A * 10/1976 Noyce ..... 72/131
4,947,670 A * 8/1990 Wu ..... 72/130
5,732,583 A * 3/1998 Itaya ..... 72/137
5,875,666 A * 3/1999 Itaya ..... 72/140
5,887,471 A 3/1999 Itaya
5,937,685 A * 8/1999 Matsuoka et al. ..... 72/137
6,142,002 A * 11/2000 Itaya ..... 72/137
6,151,942 A * 11/2000 Itaya ..... 72/137
6,701,765 B1 3/2004 Itaya

FOREIGN PATENT DOCUMENTS

| | | |
|---|---|---|
| DE | 101 34 828 A1 | 9/2002 |
| JP | 2675523 | 7/1997 |
| JP | 2690704 | 8/1997 |
| JP | 2939472 | 6/1999 |

OTHER PUBLICATIONS

Teijin Seiki K.K., Multi-forming Machine ZUB-360 Type, Oct. 1972, English Translation of pp. 2-6.

* cited by examiner

*Primary Examiner*—Dmitry Suhol
(74) *Attorney, Agent, or Firm*—Merchant & Gould, P.C.

(57) ABSTRACT

The slide motions of tools mounted on tool units (400A, 400B, 400C) are realized by a single ring gear (10) serving as a common driving force for all the tool units and arranged on a forming table (200), and cam shaft blocks (20) for transmitting the rotation force of the ring gear (10) to the tool units (400A, 400B, 400C). The cam shaft blocks (20) are formed separately from the tool units (400A, 400B, 400C). The angles of arrangement of the cam shaft blocks (20) on the forming table (200) can be changed independently of the tool units (400A, 400B, 400C).

9 Claims, 14 Drawing Sheets

SPRING MANUFACTURING APPARATUS AND DRIVING FORCE TRANSMITTING COMPONENT MOUNTED ON THE APPARATUS

FIELD OF THE INVENTION

The present invention relates to a spring manufacturing apparatus which, while continuously feeding out a wire which is to form a spring, forcibly flexes, bends, or winds the wire with a tool in a spring forming space, thereby manufacturing a spring, and a driving force transmitting component which transmits a driving force to the tool mounted on this apparatus.

BACKGROUND OF THE INVENTION

As a conventional spring manufacturing apparatus, according to one arrangement, a plurality of tools are radially arranged on a forming table at an angular interval of 90°, and the respective tools can be driven by a single gear (for example, Teijin Seiki K. K., "Multi-Forming Machine ZUB-360 Type" fabricated 1972-10).

According to another spring manufacturing apparatus, a plurality of tools are radially arranged on a forming table at an angular interval of 45° about a wire to be fed out into a spring forming space above the forming table as the center. The respective tools are supported by tool support mechanisms, and are driven by servo motors independently of each other. With this arrangement, springs having various types of shapes can be formed by numerical control (for example, see Japanese Patent No. 2675523).

According to still another spring manufacturing apparatus, a plurality of tools are radially arranged on a forming table about a wire to be fed out into a spring forming space above the forming table as the center. The respective tools are supported by tool support mechanisms, and are driven by servo motors independently of each other. The forming table is circular, and the respective tool support mechanisms can be arranged on the peripheral portion of the forming table at arbitrary angles. Therefore, the angles of arrangement of the tools about the wire as the center can be finely adjusted (for example, see Japanese Patent No. 2690704).

According to still another spring manufacturing apparatus, a wire feed mechanism for feeding a wire into a spring forming space above a forming table can be rotated about a wire axis as the center. When the wire is rotated, the same effect as that obtained by changing the angles of arrangement of the tools about the wire as the center can be obtained (for example, see Japanese Patent No. 2939472).

The conventional spring apparatuses described above have made progress and development while they have solved the problems of how to make it easier to change the forming direction for the wire in an arbitrary direction and how to increase the degree of freedom in changing to the arbitrary direction.

In the conventional spring manufacturing apparatuses, servo motors are mounted on the respective tool support mechanisms so that the respective tools can be controlled independently of each other. Also, in addition to the servo motors for driving the tools, a wire feed roller for feeding out the wire and a servo motor for rotating a wire feed mechanism are necessary. Although the controllability and formability increase due to an increase in number of tools and the newly added function, the increase in number of servo motors increases the apparatus cost.

When removing a tool support mechanism from the forming table, the corresponding servo motor is also removed simultaneously. When finely adjusting the angle of arrangement of a tool, the corresponding servo motor is also moved simultaneously. As the tool support mechanism is heavy, the operability is poor.

The apparatuses may be selectively used in accordance with applications. For example, when forming a spring having a complicated shape by forming, an apparatus having a large number of servo motors and thus having a high formability may be used. When forming a spring having a simple shape by forming, an inexpensive, simple apparatus having a small number of servo motors may be used. Consequently, an apparatus which has a high formability but is inexpensive because the number of servo motors is reduced is sought for.

SUMMARY OF THE INVENTION

The present invention has been made in view of the above problems, and has as its object to provide a spring manufacturing apparatus in which servo motors as driving sources need not be provided for respective tool support mechanisms and the angle of arrangement of each tool can be changed arbitrarily independently of the corresponding tool support mechanism, and a driving force transmitting component to be mounted on this apparatus.

It is another object of the present invention to provide a spring manufacturing apparatus in which the number of servo motors can be reduced while an increase in number of tools is allowed and which has a high formability with an inexpensive, simple structure, and a driving force transmitting component to be mounted on this apparatus.

In order to solve the above problems and to achieve the above objects, according to the present invention, there is provided a spring manufacturing apparatus comprising wire feedout means (300) for feeding out a wire into a spring forming space above a forming table (200), tool supporting means (400A, 400B, 400C), comprising a plurality of tool supporting means that can be arranged radially on the forming table from the spring forming space, for supporting a tool to be slidable toward the spring forming space, and driving force transmitting means (20), arranged on the forming table, for transmitting a driving force to drive the tools to the tooling supporting means, wherein the driving force transmitting means and the tool supporting means are formed separately, and a position of the driving force transmitting force on the forming table can be changed independently of the tool supporting means.

Preferably, the apparatus further comprises a single gear (10) which transmits the driving force to the driving force transmitting means, and the driving force transmitting means comprises a plurality of driving force transmitting means that can be arranged on the forming table while having the gear as a common driving source.

Preferably, a cam member (35, 36) which rotates by a driving force of the gear is detachably mounted on the driving force transmitting means, and the tool supporting means comprises a slider (404A) which abuts against the cam member to slide the tool.

Preferably, the cam member has a first cam (35) which drives the slider such that the tool slides toward the spring forming space, and a second cam (36) which so drives the slider as to slide the tool in a direction to retreat from the spring forming space.

Preferably, the driving force transmitting means can be connected only to a selected one of the tool supporting means.

Preferably, the tool supporting means (400B) slidably supports the tool and supports the tool to be rotatable about a tool shaft.

Preferably, the tool supporting means (400C) supports the tool slidably and supports the tool to be movable in a direction of normal to the forming table.

A driving force transmitting component mounted on a spring manufacturing apparatus according to the present invention is a driving force transmitting component mounted on a spring manufacturing apparatus which has wire feedout means (300) for feeding out a wire into a spring forming space above a forming table (200), and tool supporting means (400A, 400B, 400C), comprising a plurality of tool supporting means that can be arranged radially on the forming table from the spring forming space, for supporting a tool to be slidable toward the spring forming space, and which forcibly flexes, bends, or winds the wire in the spring forming space, thereby manufacturing a spring, the driving force transmitting component serving to transmit a driving force to drive the tool to the tool supporting means, wherein the driving force transmitting component is arranged on the forming table and formed separately from the tool supporting means, and a position of the driving force transmitting component on the forming table can be changed independently of the tool supporting means.

Preferably, the driving force transmitting component comprises a plurality of driving force transmitting means that can be arranged on the forming table while having a single gear (10), which generates a driving force to drive the tool, as a common driving source.

Preferably, a cam member (35, 36) which rotates by a driving force of the gear is detachably mounted on the driving force transmitting component, and the tool supporting means comprises a slider (404A) which abuts against the cam member to slide the tool.

Preferably, the cam member has a first cam (35) which drives the slider such that the tool slides toward the spring forming space, and a second cam (36) which so drives the slider as to slide the tool in a direction to retreat from the spring forming space.

Preferably, the driving force transmitting component can be connected only to a selected one of the tool supporting means.

As described above, according to the present invention, the servo motors as the driving sources need not be provided for the respective tool supporting means, and the angle of arrangement of the driving force transmitting component can be changed arbitrarily independently of the tool supporting means.

The number of servo motors can be reduced while allowing an increase in number of tools. The formability can be improved with an inexpensive, simple structure.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENT

An embodiment of the present invention will be described in detail with reference to the accompanying drawings. The embodiment to be described below is an example as a means for realizing the present invention. The present invention can be applied to those obtained by correcting or modifying the following embodiment within a scope not departing from the spirit of the invention.

[Overall Arrangement of Spring Manufacturing Apparatus]

Figure 1:
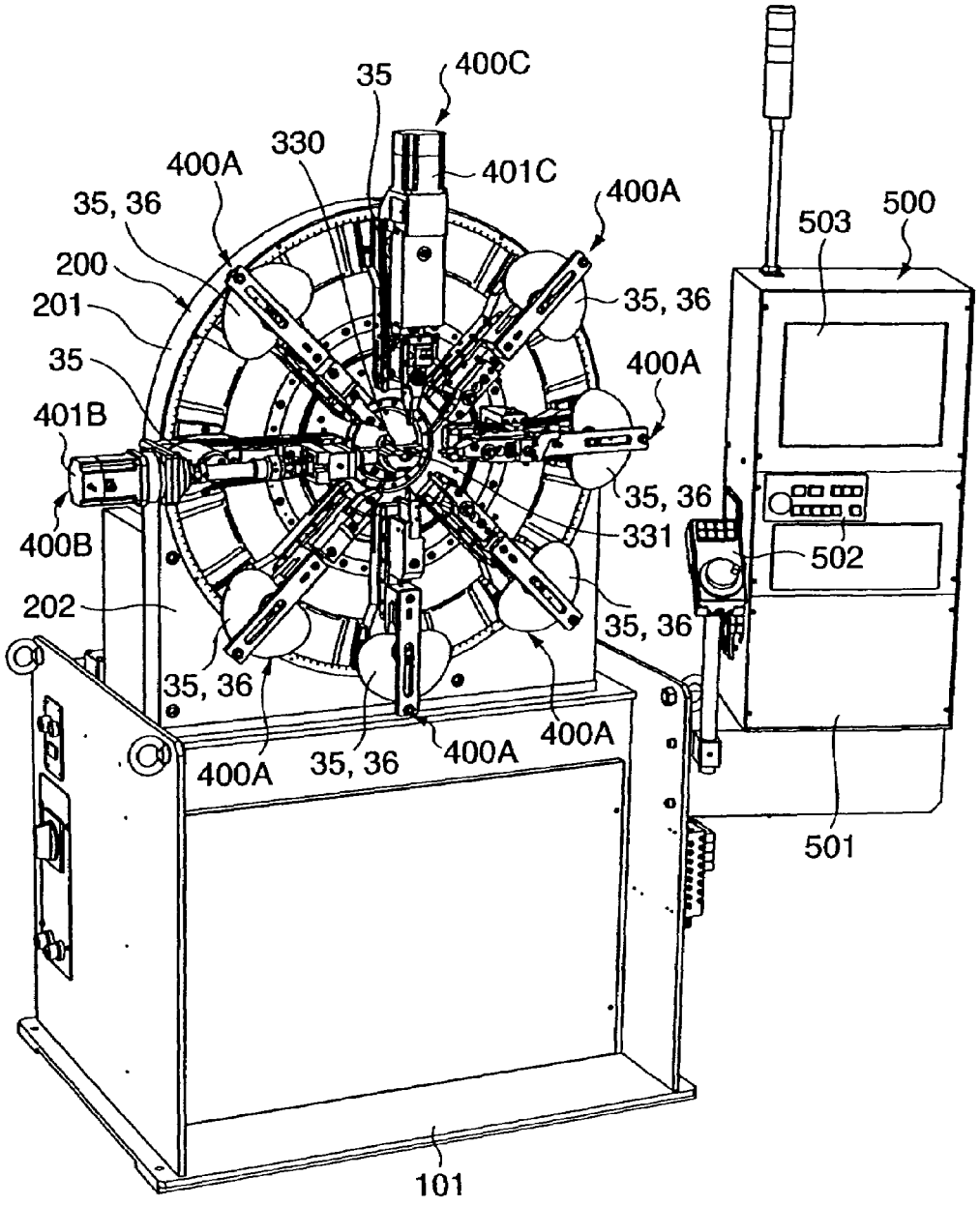
FIG. 1 is a perspective view of a spring manufacturing apparatus according to an embodiment of the present invention.
Figure 2:
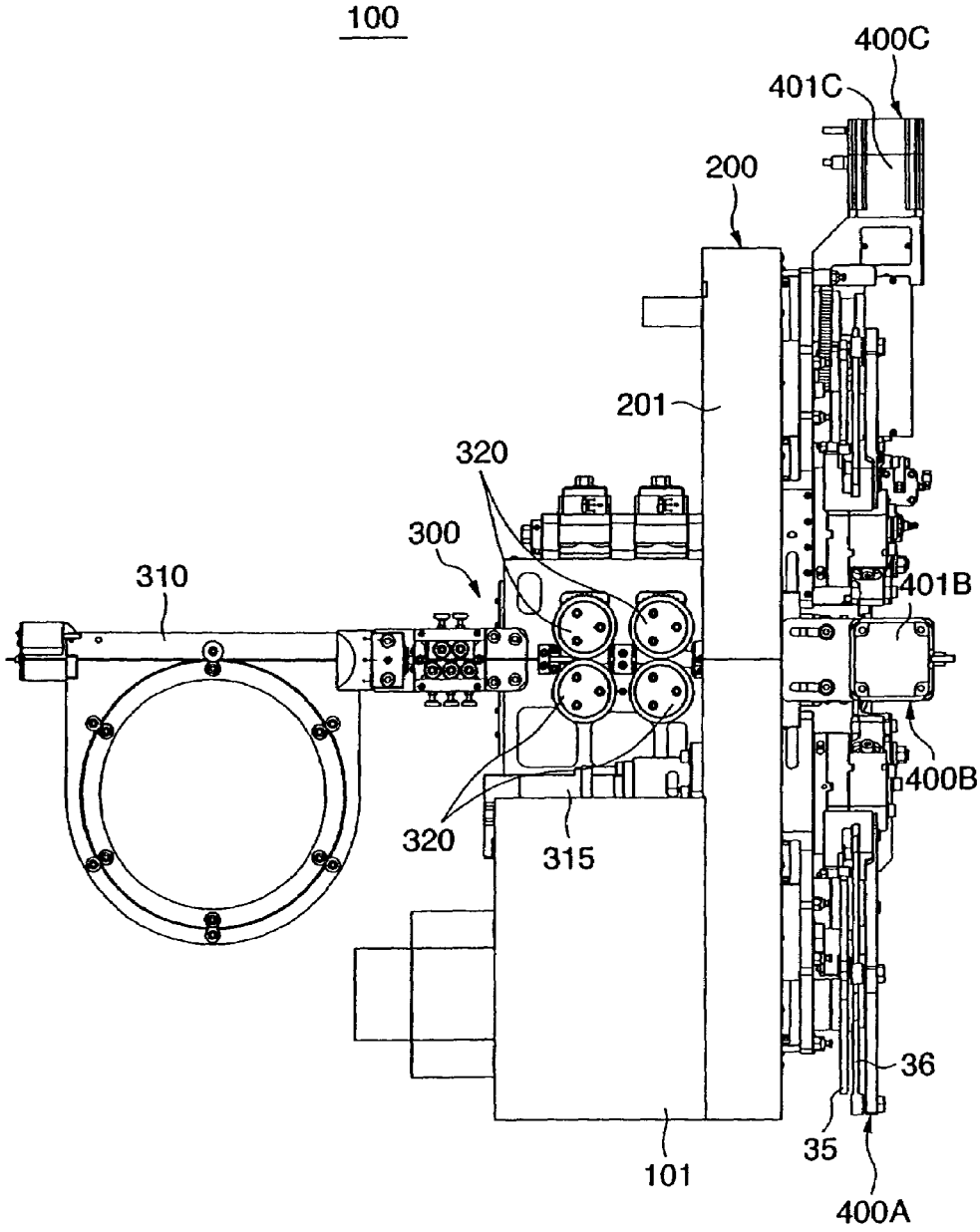
FIG. 2 is a left side view of FIG. 1.
Figure 3:
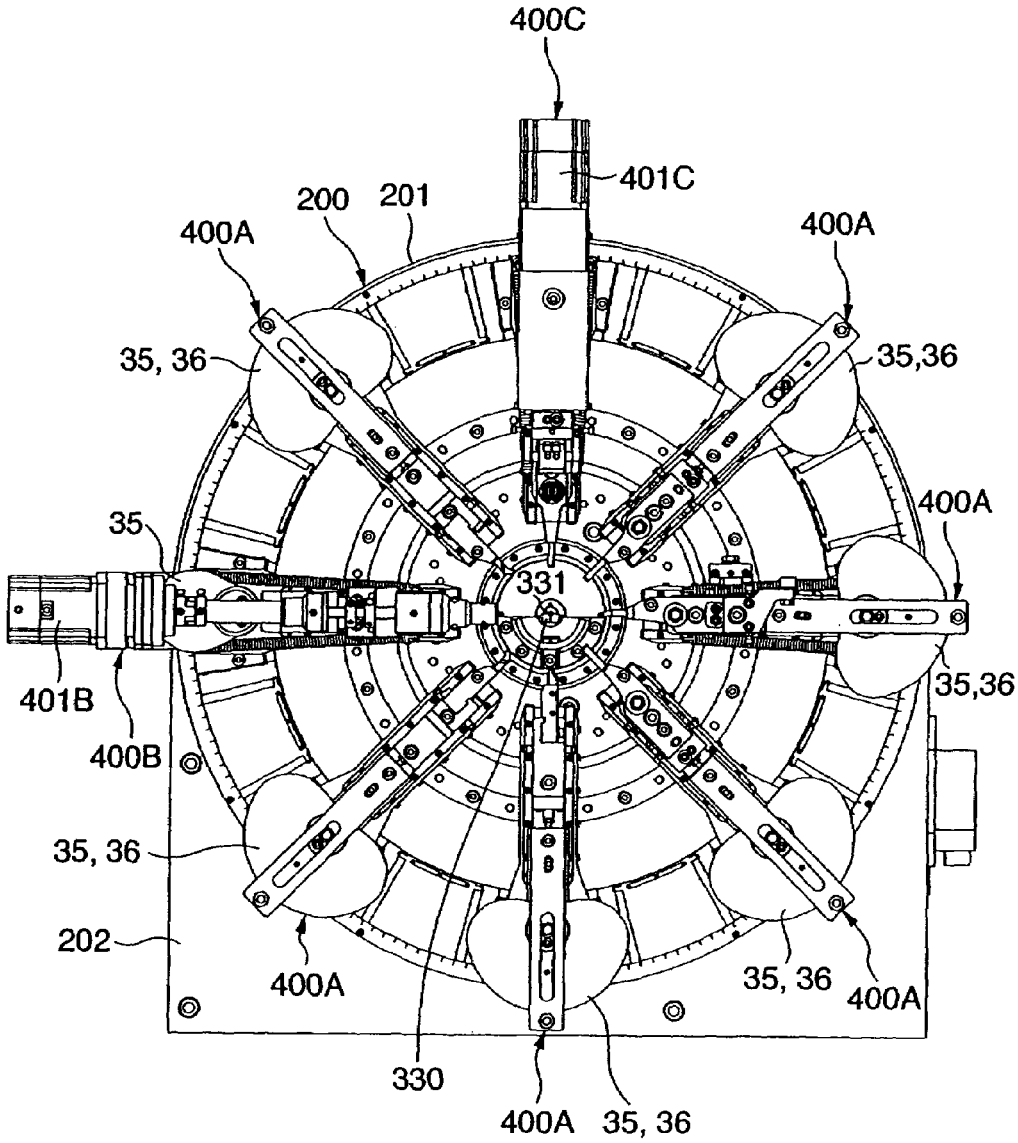
FIG. 3 is a front view of a forming table portion in the spring manufacturing apparatus of FIG. 1.
Figure 4:
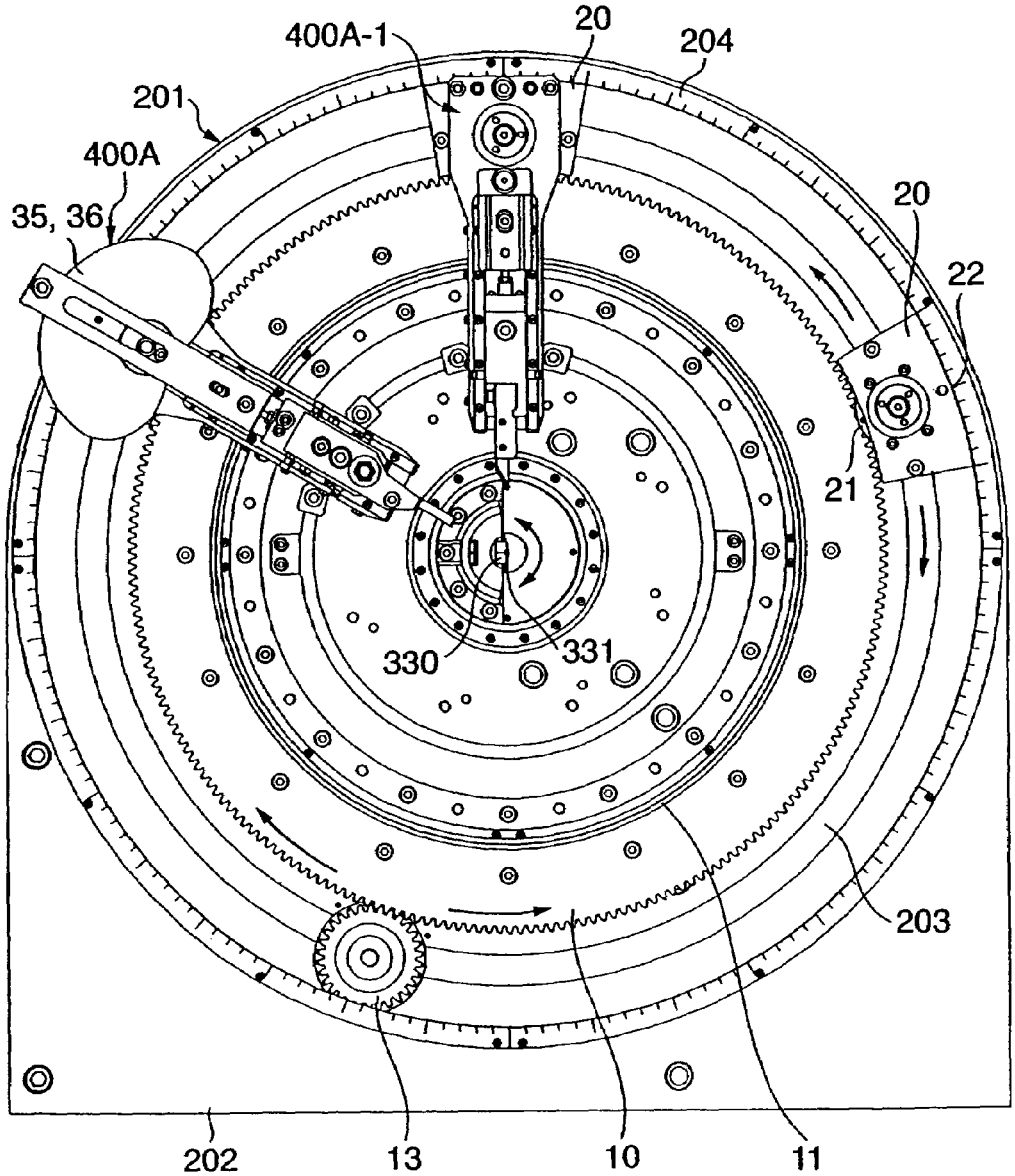
FIG. 4 is a front view showing a state wherein tools are attached to part of the forming table portion in the spring manufacturing apparatus of FIG. 1.

FIG. 1 is a perspective view of a spring manufacturing apparatus according to an embodiment of the present invention. FIG. 2 is a left side view of FIG. 1. FIG. 3 is a front view of a forming table portion in the spring manufacturing apparatus of FIG. 1. FIG. 4 is a front view showing a state wherein tools are attached to part of the forming table portion in the spring manufacturing apparatus of FIG. 1.

As shown in FIGS. 1 to 4, a spring manufacturing apparatus 100 of this embodiment has a forming table 200 standing vertically upright from a box-like base 101, a wire feeder 300 arranged behind the forming table 200, a plurality of tool units 400A, 400B, and 400C arranged radially on the front surface of the forming table 200 about the wire axis as the center, and a control unit 500 disposed beside the base 101.

The forming table 200 has a circular portion 201 and an extending portion 202 extending downward from the lower semicircular portion of the circular portion 201. The extending portion 202 is attached to the base 101. A wire guide 330 is disposed at the center of the circular portion 201. The plurality of tool units 400A, 400B, and 400C are disposed radially about the wire feedout hole (wire axis) of the wire guide 330 as the center, thus defining a spring forming space.

The wire feeder 300 has a wire feed mechanism 310 for supplying a wire that forms a spring, and a plurality of opposing wire feed roller pairs 320 for feeding out the wire from the wire feed mechanism 310. The wire pushed out by the wire feed roller pairs 320 is fed out into the spring forming space by the wire guide 330.

When the wire feed roller pairs 320 sandwiching the wire with one pair of opposing rollers are rotated in the wire feedout direction, the wire is fed out from the distal end of a wire insertion hole 331 formed in the wire guide 330.

The wire guide 330 can be rotated both in the forward and reverse directions by a servo motor 315 about the wire feedout hole 331 (wire axis) as the center. Rotation of the wire feed roller pairs 320 in the wire feedout direction is controlled by a servo motor (not shown).

The tool units 400A, 400B, and 400C comprise slide tool units 400A which can move the corresponding tools with a slide motion in a direction toward the spring forming space near the wire feedout hole 331 of the wire guide 330 or in a direction to retreat from the spring forming space, a rotary tool unit 400B which can rotate, in addition to slide, the corresponding tool about the tool axis, and a back-and-forth tool unit 400C which can move, in addition to slide, the corresponding tool in the back-and-forth direction parallel to the wire feedout direction on the front surface of the forming table 200 (that is, a direction of normal to the front surface of the forming table 200).

The slide tool units 400A, rotary tool unit 400B, and back-and-forth tool unit 400C are detachably attached to the circular portion 201 of the forming table 200. A total of 8 tool units at maximum can be attached to the forming table 200.

A tool for forcibly flexing, bending, winding, or cutting the wire feed out from the wire feedout hole 331 of the wire guide 330 into the spring forming space is mounted on each of the tool units 400A, 400B, and 400C such that it can either slide, slide and rotate, or slide and move back and forth.

The slide motions of the tools mounted on the tool units 400A, 400B, and 400C are realized by a single ring gear 10 arranged on the forming table 200 and serving as a common driving source for all the tool units, and cam shaft blocks 20 serving as driving force transmitting means (components) for transmitting the rotation force of the ring gear 10 to the tool units 400A, 400B, and 400C.

The cam shaft blocks 20 are formed independently of (separably from) the tool units 400A, 400B, and 400C. Thus, the angles of arrangement of the cam shaft blocks 20 on the forming table 200 about the wire axis as the center can be changed independently of the tool units 400A, 400C, and 400C.

The ring gear 10 is axially supported by the forming table 200 through a ring-like roller bearing 11, to be rotatable about the wire axis as the center, and meshes with a driving gear 13 pivoted by a single servo motor 12 (see FIG. 5) provided on the rear surface of the table 200. Thus, the ring bear 10 is rotated both in the forward and reverse directions.

The driving gear 13 is axially supported at a predetermined position in a groove 203 which is annularly formed in the circular portion 201 of the forming table 200 about the wire axis as the center.

Each cam shaft block 20 can be detachably mounted in the groove 203 of the forming table 200, and has a transmission gear 21 which constantly meshes with the ring gear 10 in the groove 203. The cam shaft block 20 can be fastened in or released from the groove 203. When it is released, the cam shaft block 20 can move at a position other than the driving gear 13 along the groove 203. When it is fastened, the cam shaft block 20 is fixed at an arbitrary angle.

The angle of arrangement of the cam shaft block 20 is adjusted by setting a reference portion 22 formed in the cam shaft block 20 to coincide with an arbitrary position of a scale 204 provided on the outer peripheral portion of the circular portion 201.

A plurality of cam shaft blocks 20 can be arranged on the forming table 200 to have the ring gear 10 as the common driving source. Cam members 35 and 36 which rotate by the driving force of the ring gear 10 are detachably mounted on each cam shaft block 20. The cam shaft block 20 can be connected to a corresponding tool unit such that it can transmit a driving force only to the selected tool unit.

The angle of arrangement of the cam shaft block 20 on the forming table 200 can be changed to an arbitrary angle together with the tool unit, not only when it is an isolated block but also when it is connected to the tool unit.

The cam members 35 and 36 attached to the cam shaft block 20 convert the rotational motion transmitted from the ring gear 10 and cam shaft block 20 into a translational motion, so that the corresponding tool slides through the slider of the tool unit.

The rotational motion of the tool by the rotary tool unit 400B is realized by adding a servo motor 401B as a driving source to the tool unit 400B. Similarly, the back-and-forth motion of the tool by the back-and-forth tool unit 400C is realized by adding a servo motor 401C as a driving source to the tool unit 400C.

The servo motor 401C of the back-and-forth tool unit 400C positions the corresponding tool in the back and forth direction at high precision by feedback control. This enables fine adjustment of the coil diameter, and forming in which the coil diameter is gradually increased or decreased.

The control unit 500 has a controller 501 for controlling the overall operation of the apparatus, an operating section 502 formed of a keyboard and various types of switches for inputting parameters to the controller 501 and instructing start/stop of a motion, and a display 503 formed of an LCD or the like for displaying the operating state and the like of the apparatus.

[Cam Shaft Block and Driving Gear]

Figure 5:
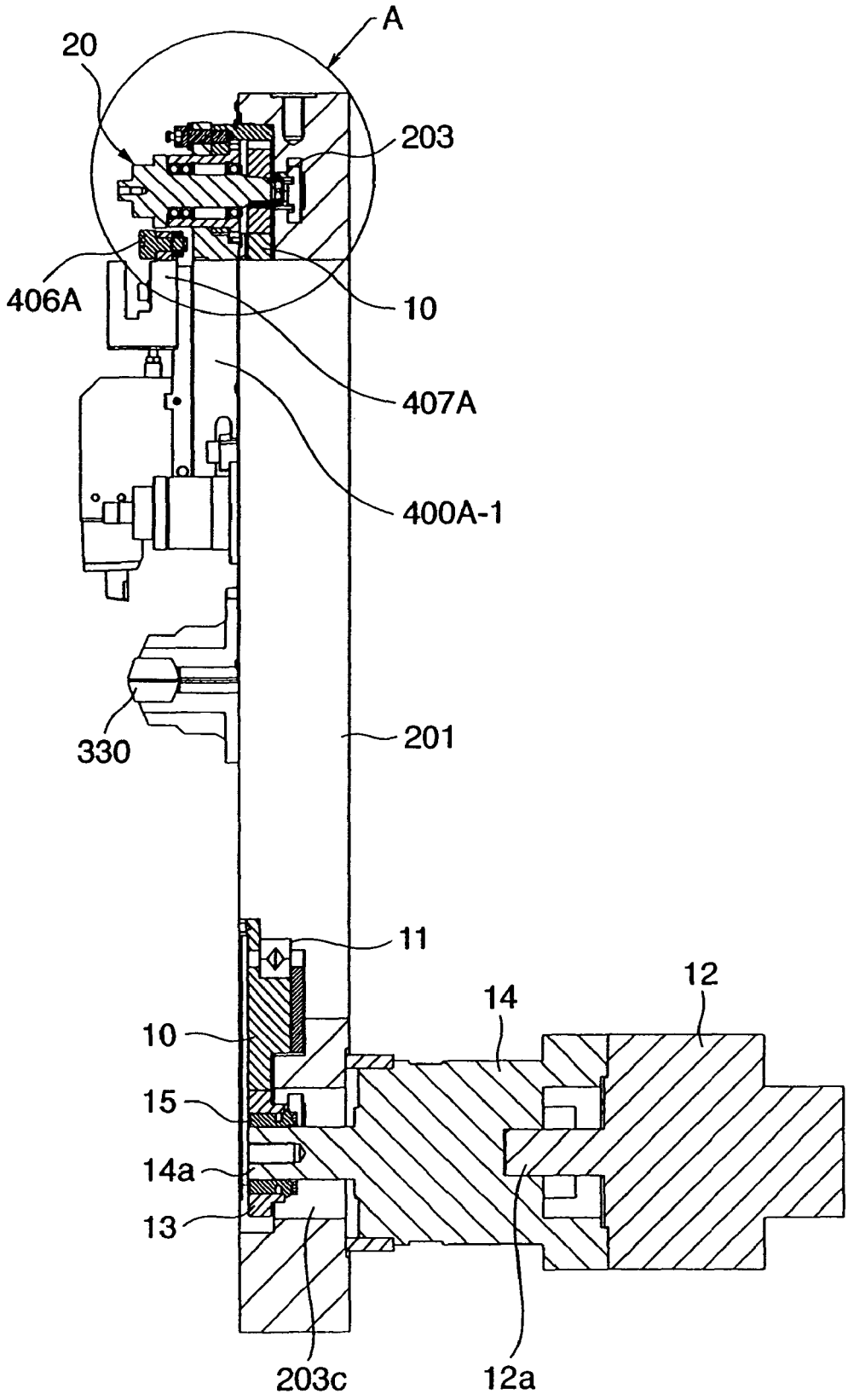
FIG. 5 is partially sectional right side view of FIG. 4 showing a cam shaft block and a driving gear.
Figure 6:
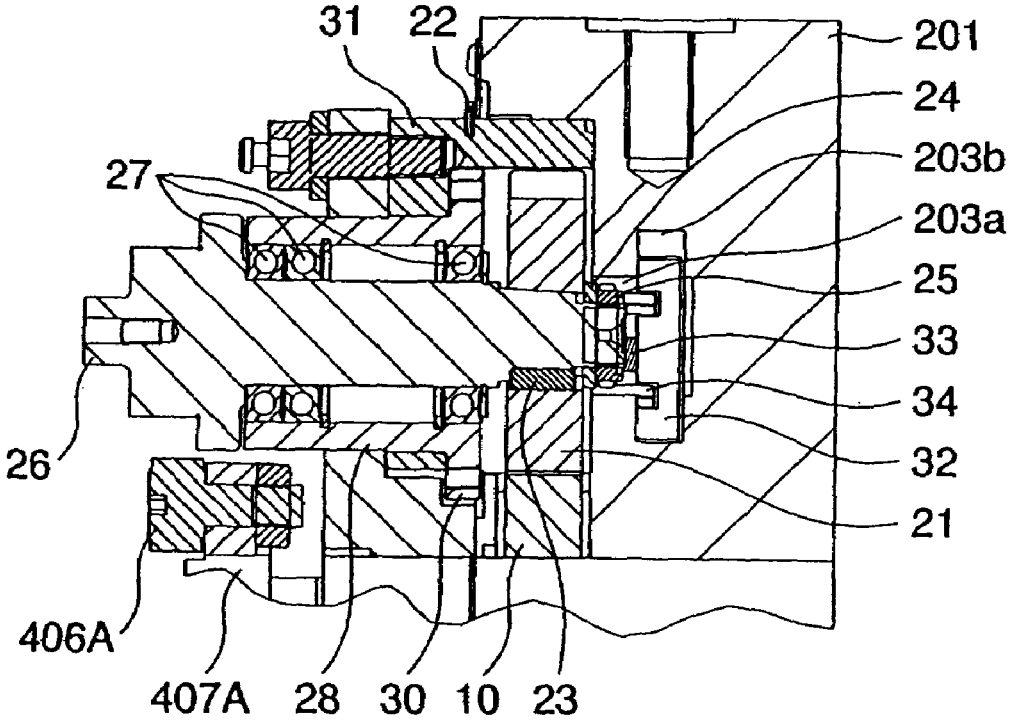
FIG. 6 is an enlarged view of a portion A shown in FIG. 5.
Figure 7:
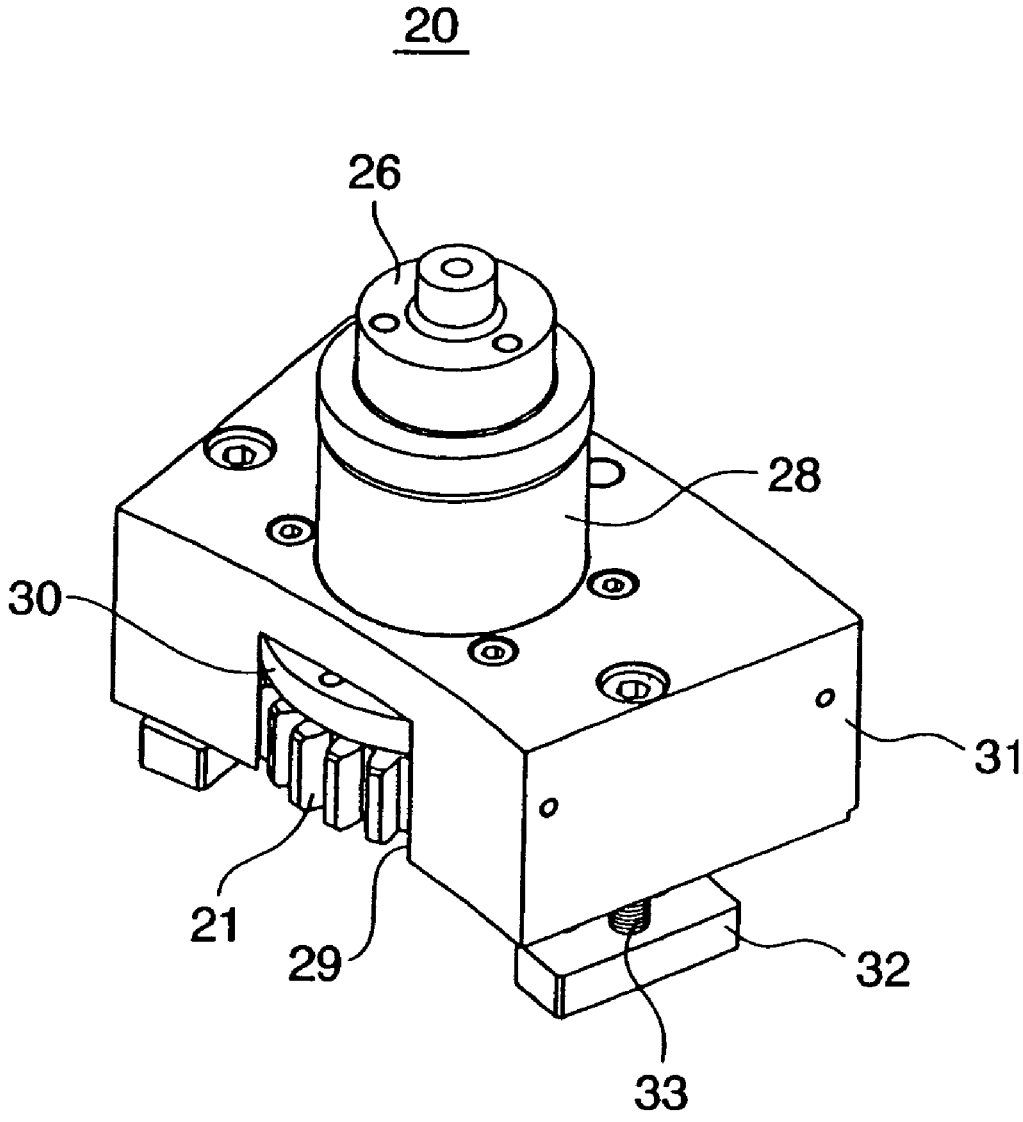
FIG. 7 is a perspective view of a cam shaft block to be mounted on the spring manufacturing apparatus according to this embodiment.
Figure 8:
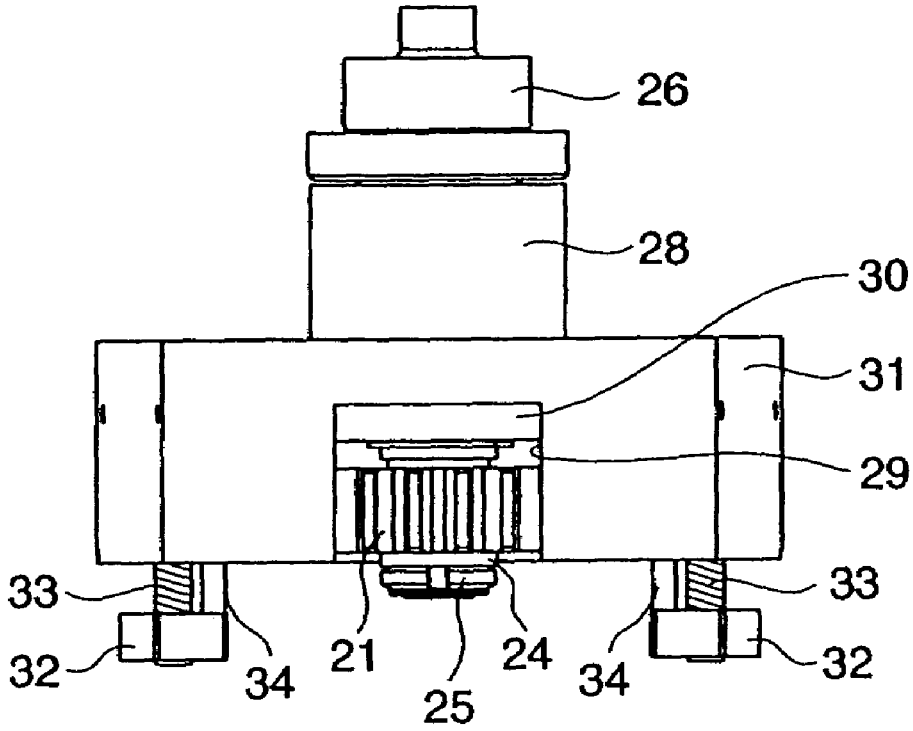
FIG. 8 is a front view of FIG. 7.
Figure 9:
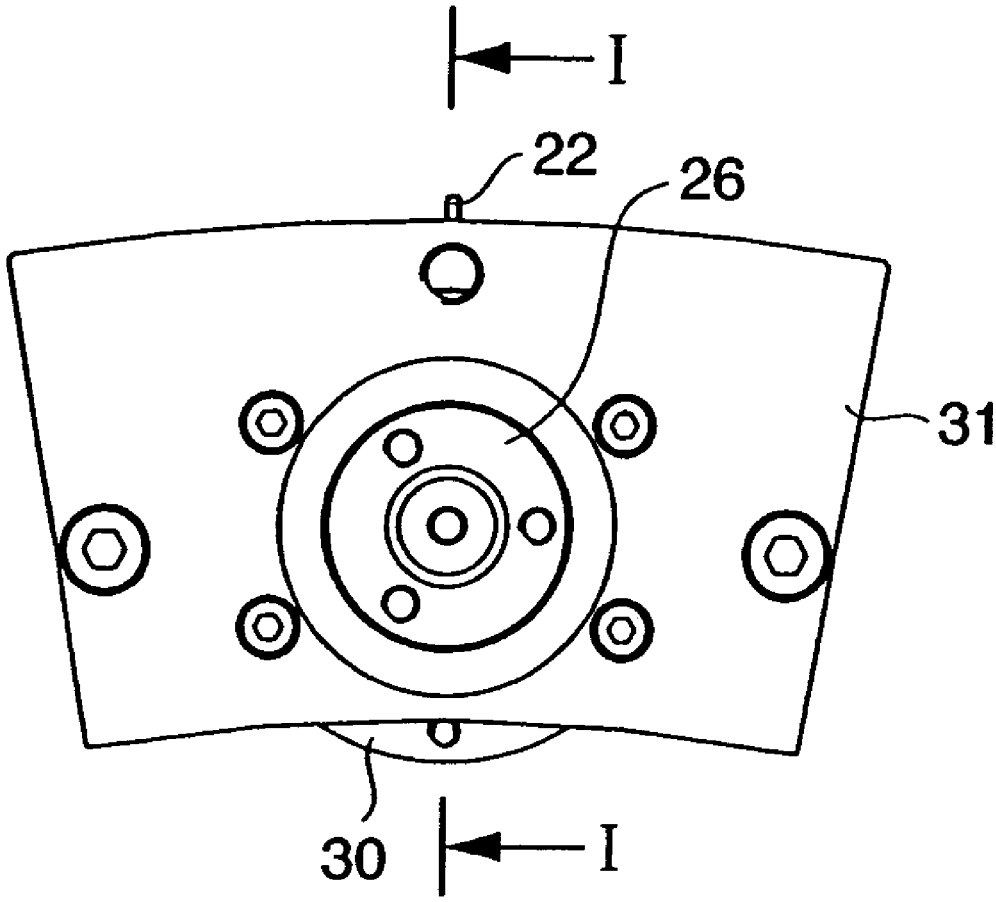
FIG. 9 is a plan view of FIG. 6.
Figure 10:
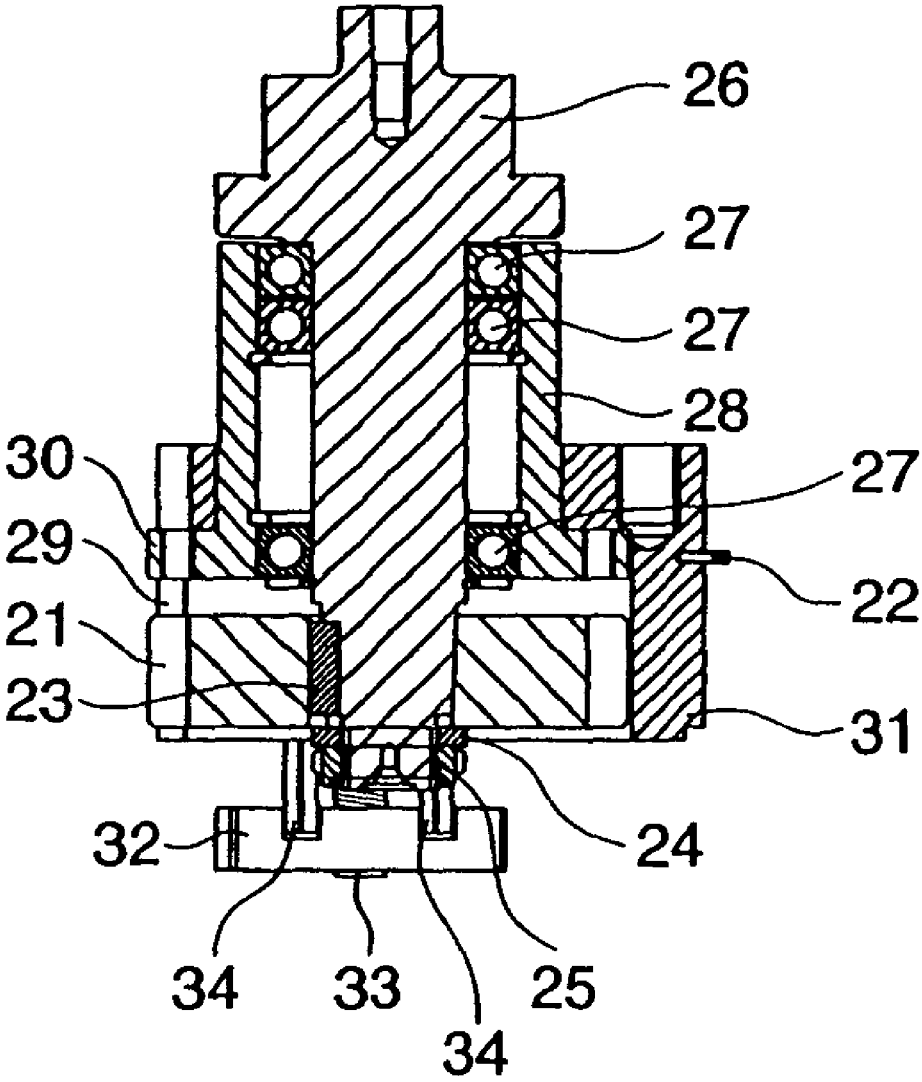
FIG. 10 is a sectional view taken along the line I—I of FIG. 9.

FIG. 5 is partially sectional right side view of FIG. 4 showing a cam shaft block and a driving gear. FIG. 6 is an enlarged view of a portion A shown in FIG. 5. FIG. 7 is a perspective view of a cam shaft block to be mounted on the spring manufacturing apparatus according to this embodiment. FIG. 8 is a front view of FIG. 7. FIG. 9 is a plan view of FIG. 6. FIG. 10 is a sectional view taken along the line I—I of FIG. 9.

As shown in FIGS. 5 to 10, the cam shaft block 20 has a shaft 26 to which the transmission gear 21 formed of a spur gear is axially mounted through a key 23, washer 24, and nut 25, a hollow axial support 28 for axially supporting the shaft 26 through a plurality of (e.g., three) bearings 27 disposed in the axial direction, and a housing 31 which has an opening 29 for partly exposing the tooth surface of the transmission gear 21 on its inner surface and which is fastened and fixed to a flange 30 of the axial support 28 with machine screws or the like.

The housing 31 has a substantially fan-like outer shape to correspond to the shape of the groove 203 formed in the circular portion 201 of the forming table 200. The reference portion 22 is provided to that outer surface of the housing 31 which is opposite to the opening 29 that partly exposes the tooth surface of the transmission gear 21.

Pieces 32 are provided under the two side portions of the housing 31 to clamp the front and rear wall portions of the groove 203 together with the housing 31, in order to fasten or release the cam shaft block 20 to or from the groove 203. The fastening force of each piece 32 can be adjusted by a bolt 33.

Each piece 32 has anti-rotation pins 34 on its inner and outer surfaces so that it will not rotate about the bolt 33 as the center.

The groove 203 has an entrance 203*a* formed in the front surface of the circular portion 201 and having a width larger than the outer shape of the nut 25, and an enlarged portion 203*b* communicating with a portion behind the entrance 203*a* and having a width larger than that of the entrance 203*a* and than the length of the piece 32. When mounting the cam shaft block 20 in the groove 203 of the forming table 200, the bolts 33 are loosened, and the anti-rotation pins 34 are removed from the pieces 32. The pieces 32 are inserted by rotation such that their longitudinal directions coincide with the circumferential direction of the groove 203. After that, the longitudinal directions of the pieces 32 are rotated in the radial direction of the groove 203, such that the reference portion 22 is aligned at a desired angle of arrangement. Then, the bolts 33 are fastened. Thus, the cam shaft block 20 is so fixed as to clamp the step in the groove 203 formed of the entrance 203*a* and enlarged portion 203*b*. When removing the cam shaft block 20 from the groove 203 of he forming table 200, a procedure opposite to that described above may be performed.

The other end of the shaft 26 to which the transmission gear 21 is not axially mounted exposes from the axial support 28. As will be described later, the cam members 35 and 36 for sliding the tool of the corresponding one of the tool units 400A, 400B, and 400C through a slider are attached to the other end.

A through hole 203*c* having an enlarged width in the radial direction and extending through the forming table 200 in the back-and-forth direction is formed in part of the lower semicircular portion of the groove 203. The driving gear 13 is disposed in the through hole 203*c*. The driving gear 13 is provided on the rear surface of the groove 203, and is axially mounted on a rotating shaft 14*a* of a reduction gear 14, connected to a driving shaft 12*a* of the servo motor 12, through a fastener 15.

The ring gear 10 is axially supported by the forming table 200 through the roller bearing 11. The rotational motion of the ring gear 10 is driven by the servo motor 12.

The ring gear 10 should have such a shape that no matter where the cam shaft block 20 may be arranged upon being moved along the groove 203, the transmission gear 21 of the cam shaft block 20 constantly meshes with the tooth surface of the ring gear 10, so that the driving force from the ring gear 10 is transmitted to the cam shaft block 20. The shape of the ring gear 10 is determined on the basis of, e.g., the outer, inner, or central diameter of the groove 203 and the diameter of the pitch circle of the transmission gear 21.

[Tool Unit]

Figure 11:
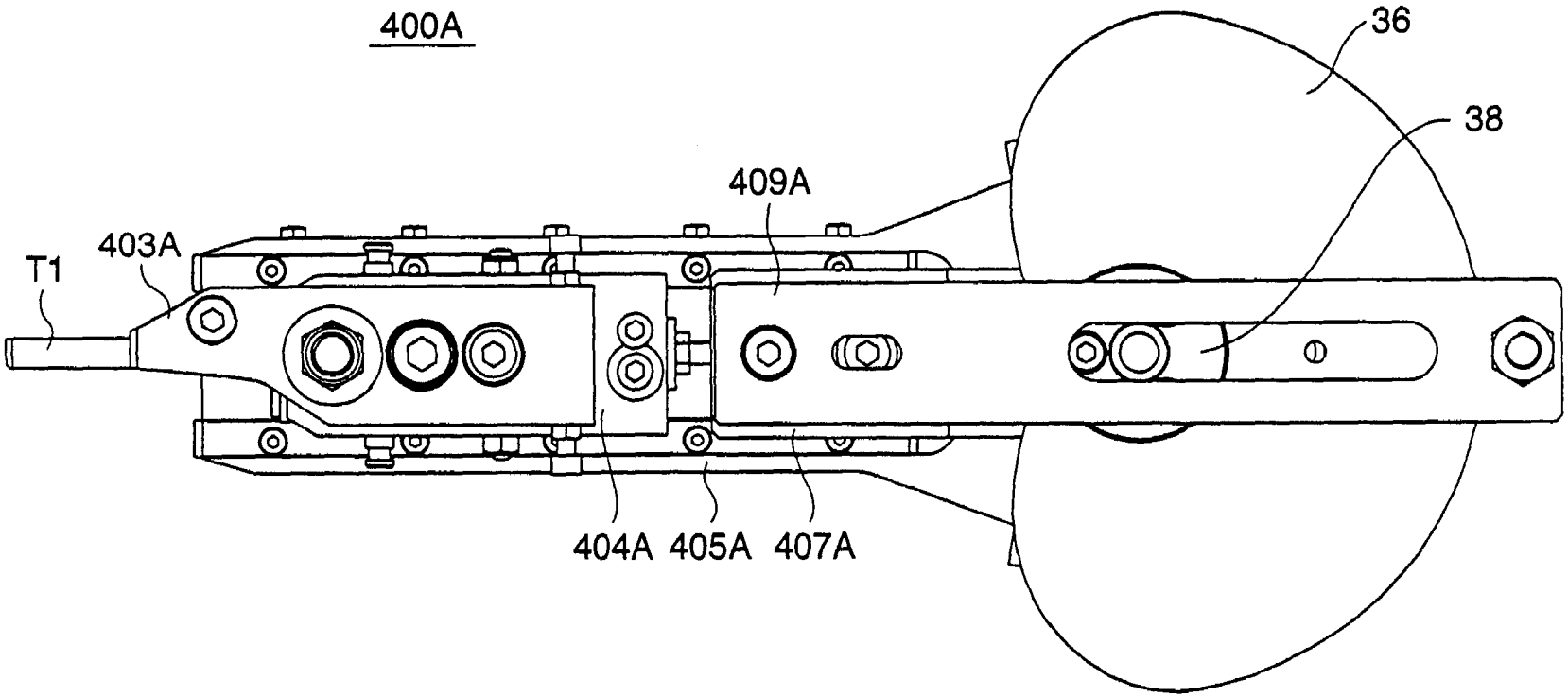
FIG. 11 is a plan view of a slide tool unit to which a cam shaft block is attached.
Figure 12:
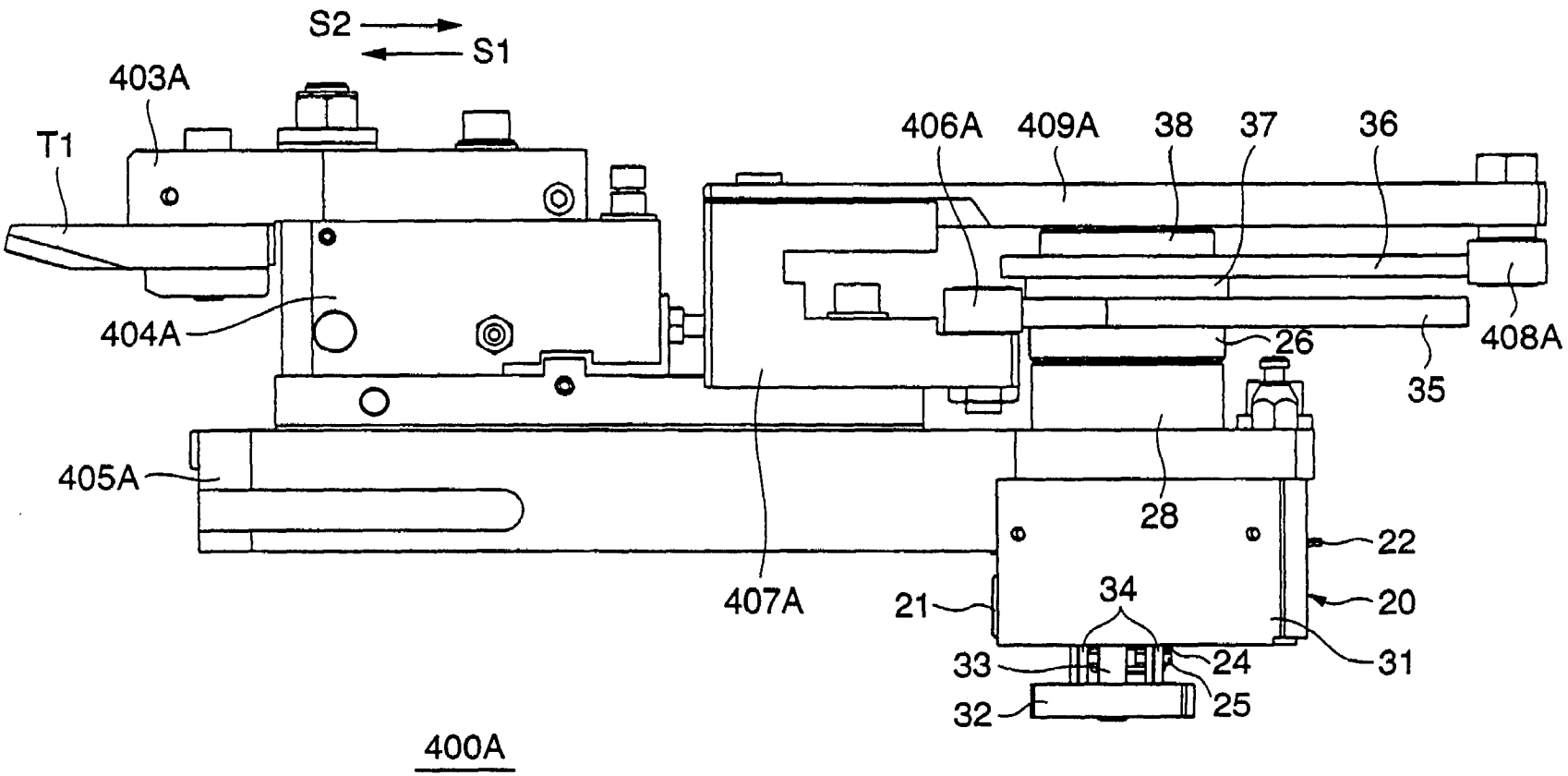
FIG. 12 is a side view of FIG. 11.
Figure 13:
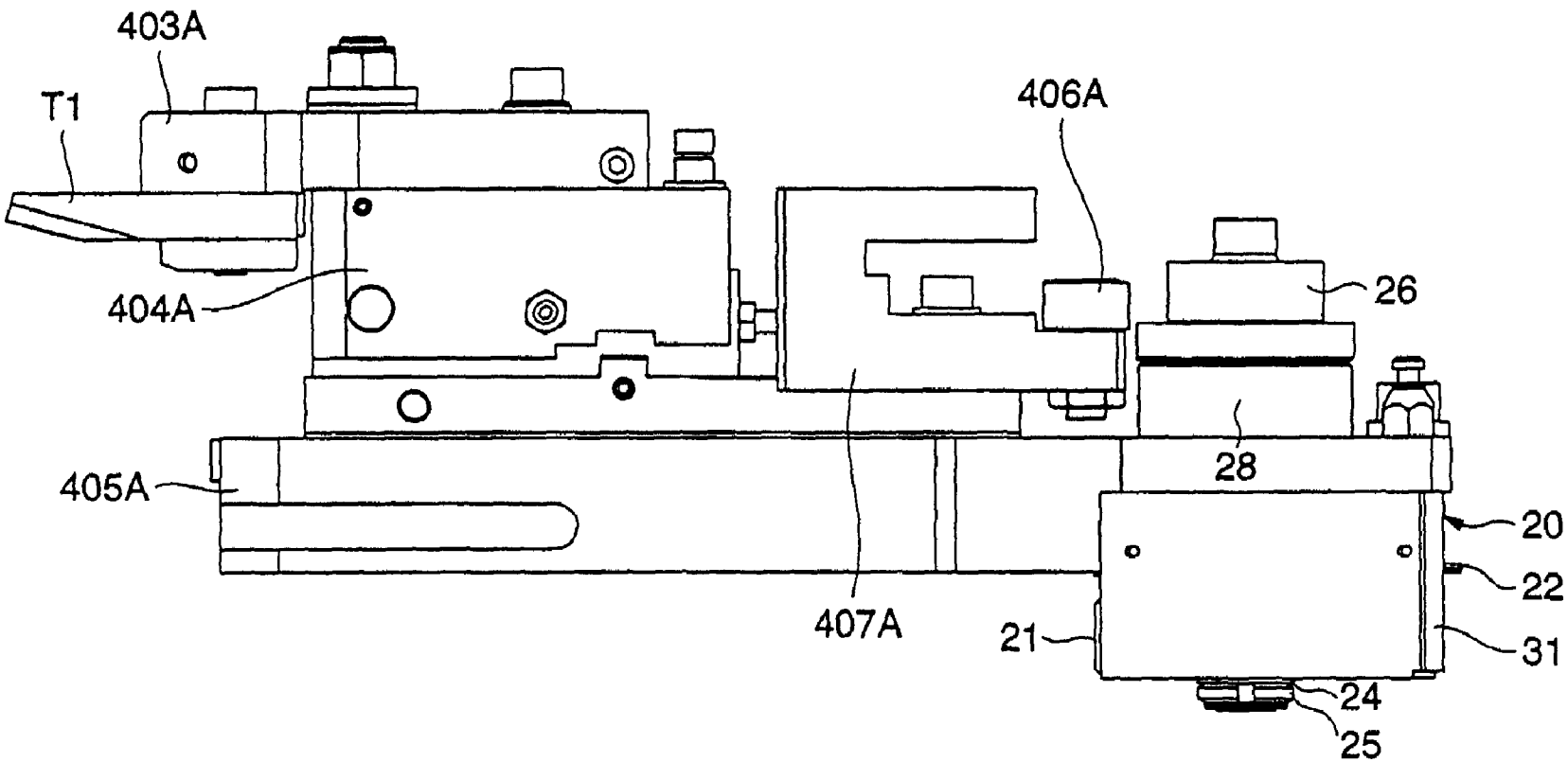
FIG. 13 is a plan view of the slide tool unit which is not connected to the slide tool unit and cam shaft block.

FIG. 11 is a plan view of the slide tool unit to which the cam shaft block is attached. FIG. 12 is a side view of FIG. 11. FIG. 13 is a plan view of the slide tool unit which is not connected to the slide tool unit and cam shaft block.

As shown in FIGS. 11 and 12, each tool unit 400A has a tool holding portion 403A for holding a bending tool T1 which abuts against the wire fed out from the wire guide and bends it with a desired coil diameter, a slider 404A to which the tool holding portion 403A is attached, and a slide rail 405A for slidably supporting the slider 404A.

The cam shaft block 20 is attached to the rear end of the slide rail 405A through its housing 31.

A first driven block 407A having a first cam follower 406A which is in constant contact with the first cam 35 attached to the shaft 26 of the cam shaft block 20, and a second driven block 409A attached to the first driven block 407A and having a second cam follower 408A which is in constant contact with the cam member 36 attached to the shaft 26 of the cam shaft block 20 are attached behind the slider 404A.

The first and second cams 35 and 36 are integrally formed as they are connected to a connecting member 37 such that they overlap at a predetermined gap in the axial direction of the shaft 26, and are detachably attached to the shaft 26 with an attaching member 38.

The first cam 35 has a cam profile that so drives the slider 404A as to slide the bending tool Ti in the direction of an arrow S1 toward the spring forming space. The second cam 36 has a cam profile that so drives the slider 404A as to slide the bending tool T1 in the direction of an arrow S2 to retreat from the spring forming space.

The first and second cams 35 and 36 form so-called double action cams which slide the tool T1 in opposite directions. This enables high-speed slide operation.

As shown in FIG. 13, when setting one tool unit 400A in a non-slide state, its first and second cams 35 and 36 may be removed from the shaft 26, and the second cam driven block 409A may be removed from the first driven block 407A. Then, the rotation force of the cam shaft block 20 is no longer transmitted to the slide tool unit 400A (see a slide tool unit 400A-1 of FIG. 4).

Other than the slide tool units 400A, the slide motions of the rotary tool unit 400B and back-and-forth tool unit 400C may be obtained by double action cams as described above. In this embodiment, only the first cam 35 is attached to the cam shaft block 20, so the tool slides in the direction of the arrow S1 toward the spring forming space. The slide motion in the direction of the arrow S2 for retreating the tool from the spring forming space uses the biasing force of a tensile spring.

[Electrical Arrangement of Controller]

Figure 14:
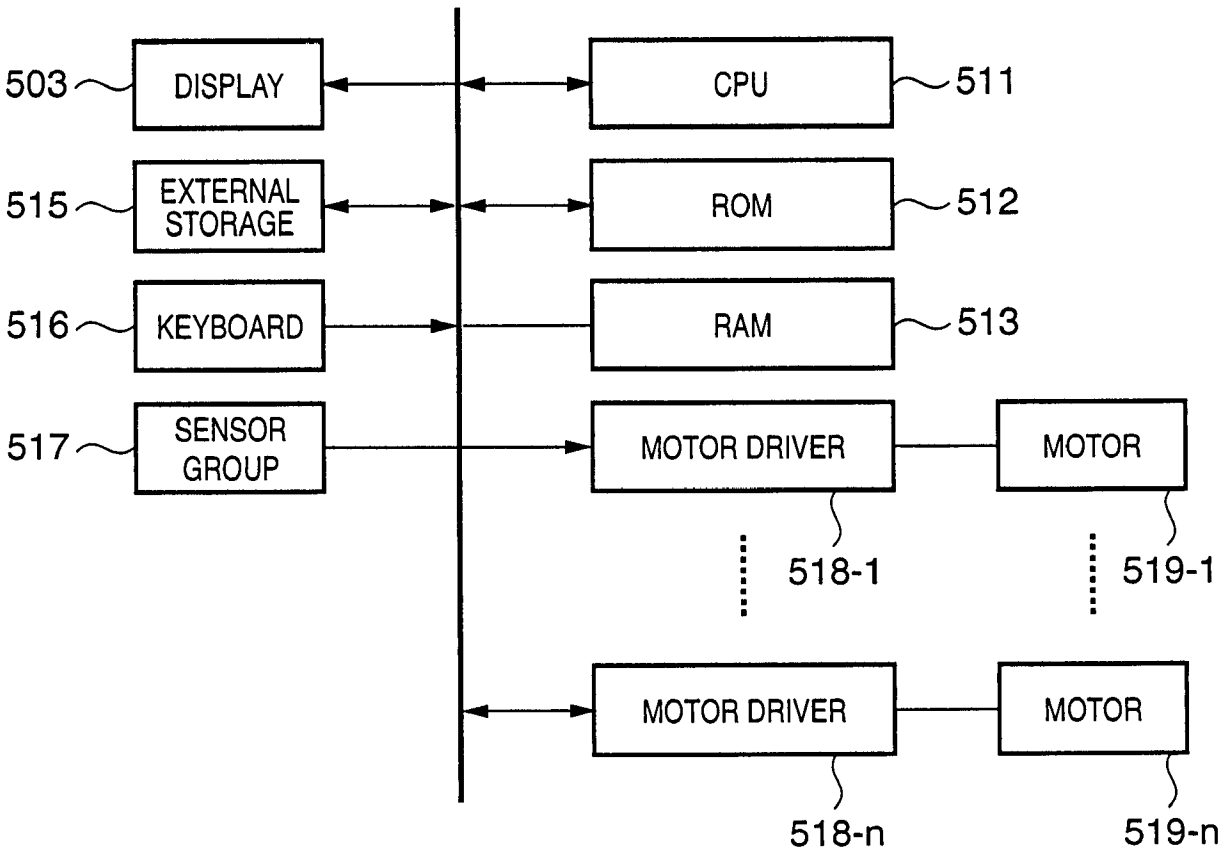
FIG. 14 is a block diagram showing the electrical arrangement of a controller for the spring manufacturing apparatus.

FIG. 14 is a block diagram showing the electrical arrangement of a controller for the spring manufacturing apparatus.

As shown in FIG. 14, the controller 501 supervises and controls the entire apparatus with a CPU 511. A ROM 512 stores the content of the operational process (program) and the like of the CPU 511. A RAM 513 is used as the work area of the CPU 511, to store a control program, position data, and the like down-loaded from the ROM 512.

The display 503 is a liquid crystal display or the like, and is used for performing various types of setting operations, displaying the setting contents, and displaying the manufacturing process by means of graphs. An external storage 515 is a flexible disk drive, a CD-ROM drive, or the like, and is used for externally supplying a program and storing the various types of setting contents necessary for wire forming. Consequently, when the external storage 515 is a flexible disk storing parameters for certain forming (e.g., if a spring is to be formed by forming, the free length, diameter, and the like of the spring), springs having the same shape can be manufactured by setting the flexible disk and performing wire forming.

A keyboard 516 is provided for setting the various types of parameters. A sensor group 517 is provided for detecting the feedout amount of the wire, the free length of the spring, and the like.

Motors 518-1 to 518-n at least include a servo motor for rotating the wire feed roller pairs 320 in the wire feedout direction, a servo motor for rotating the wire guide 330 about the wire feedout hole 331 (wire axis) as the center, and the servo motor 12 for driving the driving gear 13. When the rotary tool unit 400B or back-and-forth tool unit 400C is mounted, a servo motor for rotating the rotary tool or moving the tool in the back-and-forth direction can be selectively added. The motors 518-1 to 518-n are driven by corresponding motor drivers 519-1 to 519-n.

In this control block, in response to instructions input from the keyboard 516, the CPU 511 numerically controls the servo motors 518-1 to 518-n independently of each other, exchanges data with the external storage 515, and furthermore controls the display 503.

According to this embodiment, the cam shaft blocks 20 are formed independently of the tool units 400A, 400B, and 400C. The angles of arrangement of the cam shaft blocks 20 on the forming table 200 can be changed independently of the tool units. Hence, a separate servo motor as the driving source need not be provided for each tool unit. As servo motors indispensable for the apparatus, it suffices as far as at least three servo motors are mounted (that is, a servo motor for rotating the wire feed roller pairs 320 in the wire feedout direction, the servo motor 315 for rotating the wire guide 330 about the wire feedout hole 331 (wire axis) as the center, and the servo motor 12 for rotating the driving gear 13 (ring gear 10)). As compared to the conventional apparatus, the number of servo motors can be reduced. An apparatus with a high formability can be realized with an expensive, simple structure.

Furthermore, the plurality of cam shaft block 20 can be arranged on the forming table 200 such that they use the single ring gear as the common driving source. As the angles of arrangement of the cam shaft blocks 20 can be arbitrarily changed independently of the tool units, when finely adjusting the angles of arrangement of the tool units, the servo motors need not be dislocated simultaneously. This improves the operability.

As the cam members are detachably mounted on each cam shaft block 20, of the tool units attached to the forming table 200, those that the user wishes to use can be selected arbitrarily. Cam members can be attached to only the wanted tools in order to drive them. Therefore, the cumbersome operations of attaching and removing the tool units can be omitted.

As the cam members form the so-called double action cams comprised of the first and second cams 35 and 36 which slide the tool in the opposite directions, a high-speed slide motion is enabled.

In addition to the slide tool units 400A, the rotary tool unit 400B or back-and-forth tool unit 400C may be added. When such a tool unit is added, no new servo motor need be added to slide the corresponding tool. The number of servo motors can be reduced while improving the formability by allowing an increase in number of tools.

The present invention is not limited to the above embodiments and various changes and modifications can be made within the spirit and scope of the present invention. Therefore, to appraise the public of the scope of the present invention, the following claims are made.

What is claimed is:

1. A spring manufacturing apparatus comprising:

a wire feedout unit that feeds out a wire into a spring forming space above a forming table;

a plurality of tool supporting units that can be arranged radially on said forming table from the spring forming space, wherein each of the tool supporting units supports a tool to be slidable toward the spring forming space;

a plurality of driving force transmitting units that are selectively connected to each of the tool supporting units on said forming table and transmit a driving force to drive the tool by each of the tooling supporting units; and a single gear which transmits the driving force to said plurality of driving force transmitting units, wherein said driving force transmitting unit and the tool supporting unit are formed separately, each of said driving force transmitting units has a transmission gear which meshes with said single gear, as a common driving source, and a position of said driving force transmitting unit on said forming table can be changed independently of the tool supporting unit while allowing the transmission gear to mesh with said single gear.

2. The apparatus according to claim 1, wherein a cam member which rotates by a driving force of said transmission gear is detachably mounted on said driving force transmitting unit, and the tool supporting unit comprises a slider which abuts against said cam member to slide the tool.

3. The apparatus according to claim 2, wherein said cam member has a first cam which drives said slider such that the tool slides toward the spring forming space, and a second cam which so drives said slider as to slide the tool in a direction to retreat from the spring forming space.

4. The apparatus according to claim 1, wherein said driving force transmitting unit can be connected only to a selected one of the tool supporting unit.

5. The apparatus according to claim 1, wherein the tool supporting unit slidably supports the tool and supports the tool to be rotatable about a tool shaft.

6. The apparatus according to claim 1, wherein the tool supporting unit supports the tool slidably and supports the tool to be movable in a direction of normal to said forming table.

7. A driving force transmitting component mounted on a spring manufacturing apparatus which has a wire feedout unit that feeds out a wire into a spring forming space above a forming table, and a plurality of tool supporting units that can be arranged radially on said forming table from the spring forming space, and each of which supports a tool to be slidable toward the spring forming space, said component comprising:

a shaft that transmits a driving force for sliding the tool toward the spring forming space to the tooling supporting unit;

a transmission gear that is provided at an end of the shaft and meshes with a single gear provided on the forming table, as a common driving source; and a housing that supports said shaft and transmission gear, wherein a position of said housing on the forming table can be changed independently of the tool supporting units while allowing the transmission gear to mesh with said single gear;

wherein a plurality of the driving force transmitting components are provided and formed separately from the tool supporting units, and each of said driving force transmitting components is selectively connected to each of the tool supporting units on said forming table.

8. The component according to claim 7, wherein a cam member which rotates by a driving force of said transmission gear is detachably mounted on the driving force transmitting component, and the tool supporting unit comprises a slider which abuts against said cam member to slide the tool.

9. The component according to claim 8, wherein said cam member has a first cam which drives said slider such that the tool slides toward the spring forming space, and a second cam which so drives said slider as to slide the tool in a direction to retreat from the spring forming space.

* * * * *